US005661881A

United States Patent [19]

Menchetti

[11] Patent Number: 5,661,881

[45] Date of Patent: Sep. 2, 1997

[54] METHOD OF MAKING FRAMING COMPONENTS OF EXPANDED METAL

[75] Inventor: Robert J. Menchetti, Buffalo, N.Y.

[73] Assignee: National Gypsum Company, Charlotte, N.C.

[21] Appl. No.: 593,820

[22] Filed: Jan. 30, 1996

Related U.S. Application Data

[62] Division of Ser. No. 189,051, Jan. 31, 1994, Pat. No. 5,524,410.

[51] Int. Cl.[6] ..... B21D 31/04

[52] U.S. Cl. ..... 29/6.1; 29/416; 29/897.31

[58] Field of Search ..... 29/416, 61, 897.3, 29/897.35, 897.312, 897.31; 52/729.2, 635, 729.1, 729.5, 737.1

[56] References Cited

U.S. PATENT DOCUMENTS

| | | | |
|---|---|---|---|
| 509,770 | 11/1893 | Scott | 29/416 X |
| 593,484 | 11/1897 | Mauser . | |
| 652,990 | 7/1900 | Wood | 29/416 X |
| 1,311,820 | 7/1919 | Jones . | |
| 1,644,940 | 10/1927 | Moyer . | |
| 1,741,423 | 12/1929 | Lachman . | |
| 2,141,642 | 12/1938 | Cross . | |
| 2,990,038 | 6/1961 | Diamond . | |
| 3,283,464 | 11/1966 | Litzka . | |
| 3,626,653 | 12/1971 | Amirikian . | |
| 3,874,051 | 4/1975 | Malik . | |
| 4,010,524 | 3/1977 | Osamu et al. | 29/416 X |
| 4,071,995 | 2/1978 | Farmer . | |
| 4,152,873 | 5/1979 | Burke . | |
| 4,545,170 | 10/1985 | Shirey . | |
| 4,555,889 | 12/1985 | Mankowski . | |
| 4,866,899 | 9/1989 | Houser . | |
| 4,894,898 | 1/1990 | Walker . | |
| 5,060,352 | 10/1991 | Barker . | |

FOREIGN PATENT DOCUMENTS

| | | |
|---|---|---|
| 391245 | 12/1973 | U.S.S.R. . |
| 1609-529-A | 11/1990 | U.S.S.R. . |

*Primary Examiner*—Joseph M. Gorski
*Attorney, Agent, or Firm*—Marshall, O'Toole, Gerstein, Murray & Borun

[57] ABSTRACT

An elongated metal structural member including an expanded metal web formed by severing a metal strip along a sinuous path forming a plurality of keystone-shaped tabs on each half, moving the two halves directly away from each other until outer corners of the tabs of one half overlap outer corners of the tabs of the other half, and affixing together the outer corners of one half with outer corners of the other half.

10 Claims, 2 Drawing Sheets

METHOD OF MAKING FRAMING COMPONENTS OF EXPANDED METAL

RELATED APPLICATIONS

This is a division of application Ser. No. 08/189,051 filed Jan. 31, 1994 and now U.S. Pat. No. 5,524,416.

FIELD AND BACKGROUND OF THE INVENTION

This invention relates to novel, expanded metal framing such as a metal framing stud, and to the method of making such a component.

It has been recognized in the past that metal structural members having a central web portion, such as the common formed sheet metal I-studs and C-studs, floor and ceiling tracks, etc., can be made with less metal, and thus at less cost and weight, by eliminating part of the material in the web. One method of this nature is by cutting and expanding the metal of the web.

An example of a structural member having an expanded web is disclosed in U.S. Pat. No. 3,283,464, wherein the web of a member is cut longitudinally into two parts along a sinuous path, thereby forming two matched halves having a serrated cut edge. After cutting, the two halves are placed together with the high points of each cut edge abutting each other, and the high points are attached as by welding. In the above patent, the process necessitates shifting one of the two halves lengthwise relative to the other half in order for the high points to abut each other. In a continuous manufacturing process wherein a very long strip of metal is cut and formed, this shifting requires an additional somewhat complicated step in the overall process. A further disadvantage is that only small areas of the cut edges of the two halves are in engagement.

SUMMARY OF THE INVENTION

The present invention comprises the method of cutting the web of a metal structural member into two parts along a sinuous path, the sinuous path involving turns of over 90°, thereby forming a series of alternating keystone or dovetail-shaped sections on each half of the web. The two halves are then moved straight apart until the outer corners of the sections of the webs are overlapped, and these overlapping corners are then secured together as by welding or by folding to form an interlocking connection.

It is therefore an object of the invention to provide a more simplified method of reducing the metal in a web section of a structural member.

It is a further object to provide a novel, economical, metal structural member.

BRIEF DESCRIPTION OF THE DRAWINGS

These and other objects and advantages of the invention will be more readily apparent when considered in relation to the preferred embodiments as set forth in the specification and shown in the accompanying drawings, in which.

DETAILED DESCRIPTION OF THE INVENTION

Figure 1:
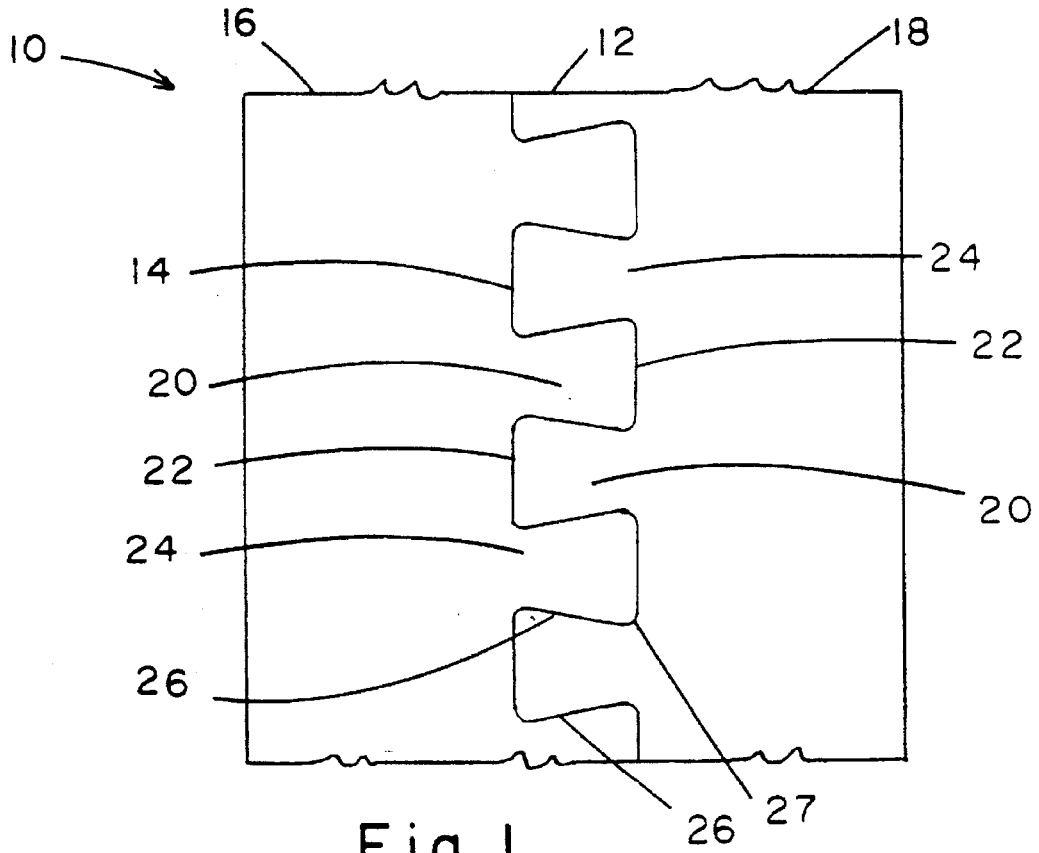
FIG. 1 is a side view of a strip of sheet metal, prior to being formed into an I-stud, showing the path in the cut of the web, in accordance with the present invention.

Referring first to FIG. 1, there is shown an elongated strip 10 of sheet metal. The strip 10 has a width sufficient to form a sheet metal stud, such as an I-stud or a C-stud and includes an elongated center portion 12, suitable for forming the web portion of the metal stud.

The center portion 12 is cut along a continuous, sinuous shear line 14. In accordance with this invention, the center portion 12 is severed along the shear line 14 to create two substantially identical halves 16 and 18, each half including a series of longitudinally spaced dovetail or keystone-shaped tabs or sections 20.

Each tab 20 has an outer edge 22 which has a greater longitudinal dimension than that of the tab inner end 24. Each tab further has two side edges 26, each of which is angled outwardly from the inner end 24 to the outer edge 22. In a specific example of the invention, each tab 20 is 1¾ inches deep (measured laterally of the length of the strip), has an outer edge 22 that is 3 inches wide and has an inner end 24 that is 1 inch wide. These dimensions form a repeating pattern every 4 inches, and form a gap 23 (FIG. 2) between the outer ends of adjacent tabs of about 1 inch.

Figure 2:
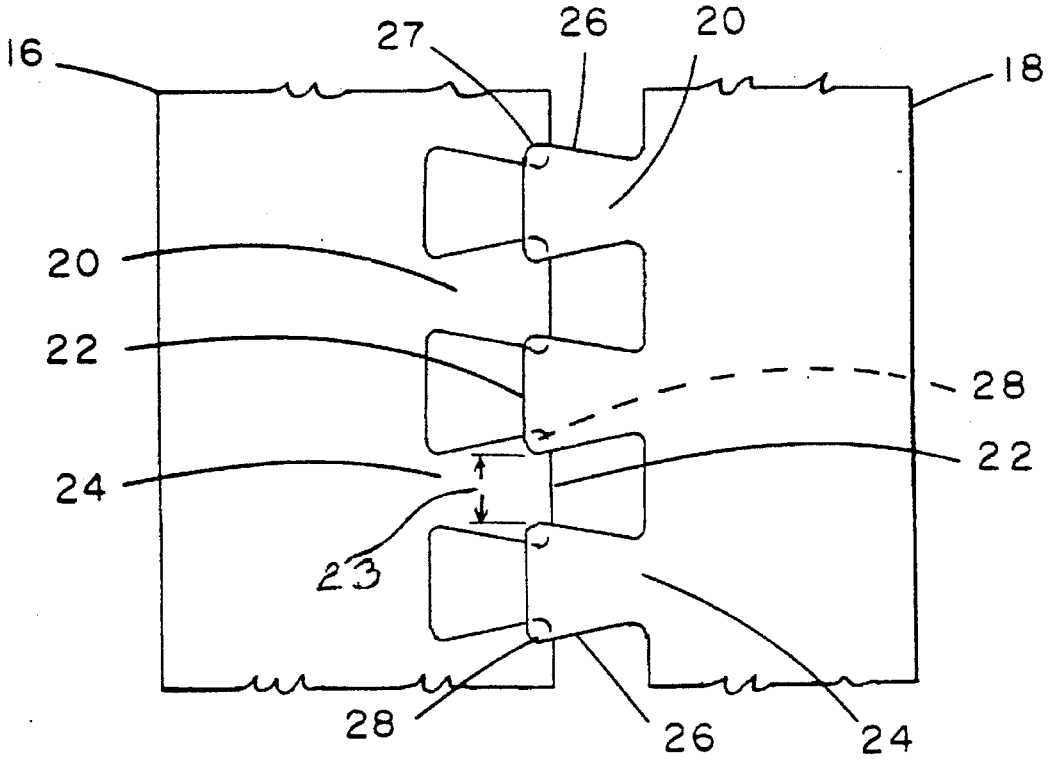
FIG. 2 is a side view of the strip of metal of FIG. 1 with the two halves moved apart.

Referring now to FIG. 2, the two substantially identical halves 16 and 18 will be seen to have been moved laterally directly away from each other, which can be easily accomplished with continuous sheet metal forming equipment. The two halves are moved apart only to the extent that the corner portions 28 of tabs 20 of one half 16 overlap the corner portions 28 of the tabs 20 of the other half 18. The overlapping corner portions 28 are the small areas at the junctions of the side edges 26 and the outer edges 22 of each tab 20. The overlap in the above specific example is about ⅜ inch.

With the two halves 16 and 18 in the partially moved apart positions of FIG. 2, the two halves are secured at the overlapping corner portions 28, and the secured halves are roll-formed to produce an end product such as an I-stud or a C-stud.

Figure 3:
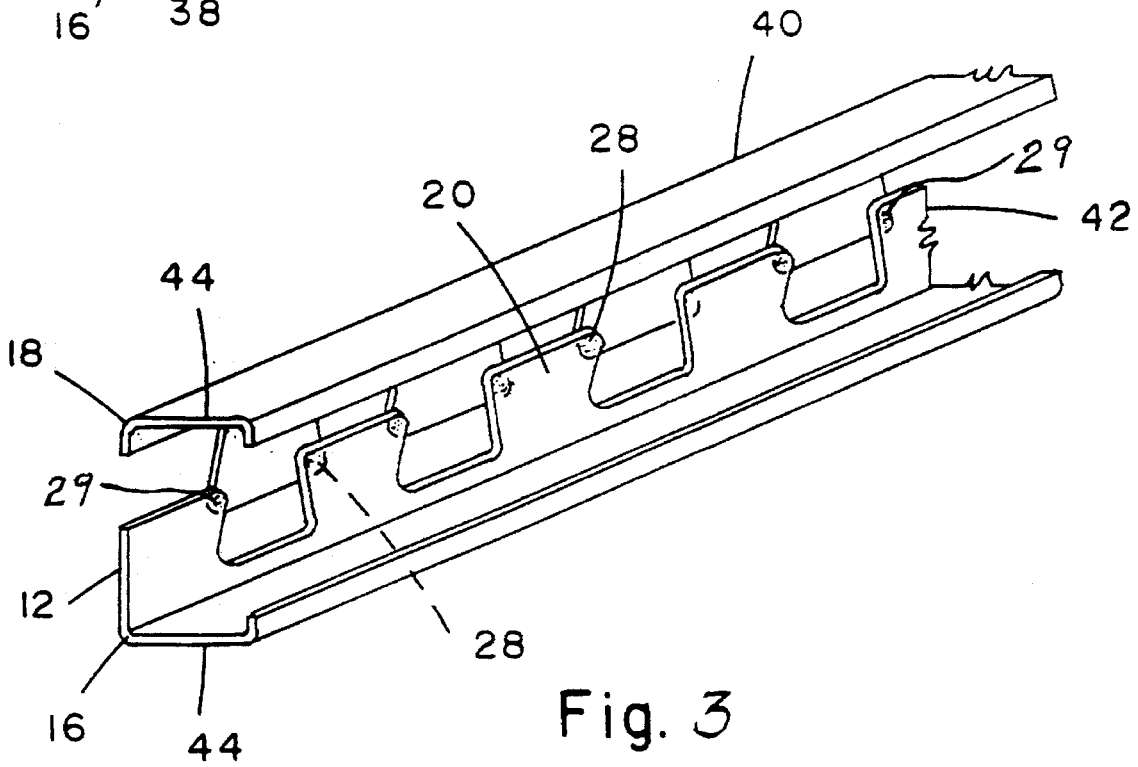
FIG. 3 is a perspective view of a C-stud formed from the strip of FIGS. 1 and 2, with the two halves welded together at overlapping portions.

Referring to FIG. 3, an expanded C-stud 40 is shown. The corners 28 of one half 16 are welded (such as spot welding) as indicated by the numeral 29 to the corners 28 of the other half 18, forming a rigid, expanded web 42. The strip is then roll-formed to shape the flanges 44 to complete the expanded web C-stud 40.

Figure 4:
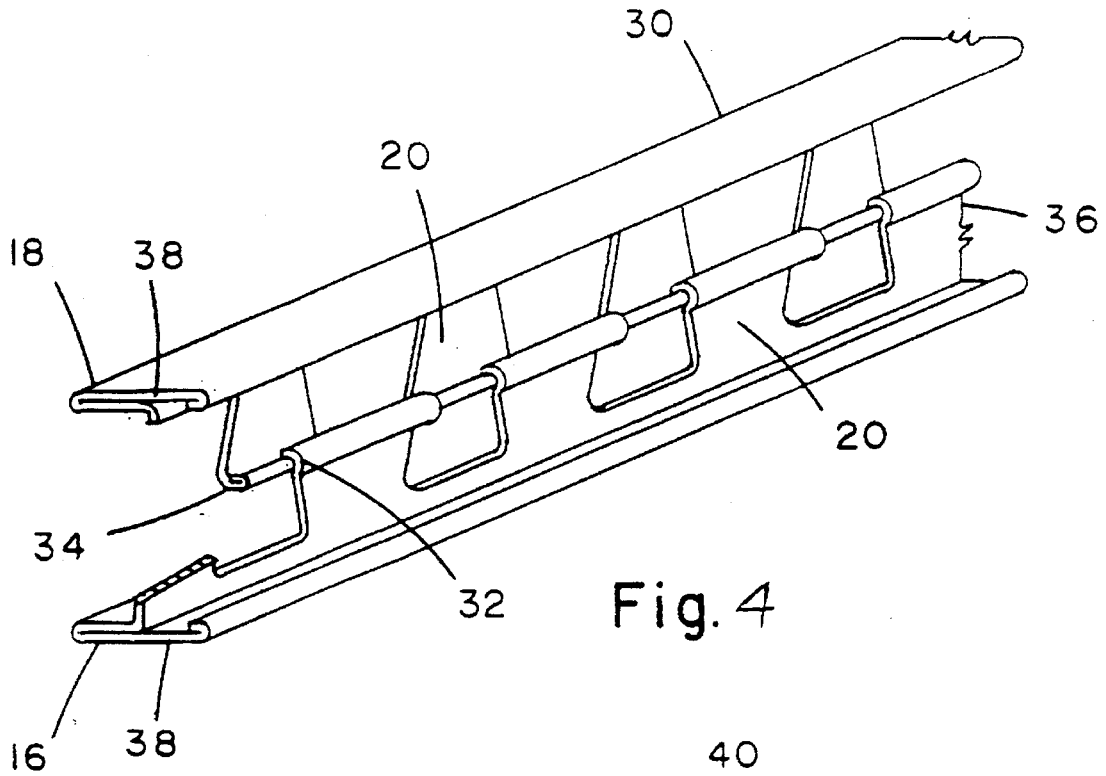
FIG. 4 is a perspective view of an I-stud formed from the strip of FIGS. 1 and 2, with the overlapping portions of the two halves roll-formed in a manner such as to attach the two halves.

An expanded I-stud 30 is shown in FIG. 4, which is formed by moving the two stud halves 16 and 18 directly apart from one another, until only the corner portions 28 overlap, as previously described. The overlapping corner portions 28 are only large enough to permit affixing together of the abutting, overlapping corner portions 28.

In forming the expanded I-stud 30, the abutting, overlapping corner portions 28 are affixed together by forming U-shaped reverse bends 32 and 34 along the outer edges 22 of all of the tabs 20. The reverse bend 32 of the half 16 is a larger, relatively open-bend, and it grasps within it the relatively smaller reverse bend 34, at the overlapping corner portions 28. By crimping the material of reverse bends 32 and 34 very tightly together, a rigid, expanded web 36 is created. The flanges 38 are then roll-formed to the shape of the expanded web I-stud 30.

Expanded I-stud 30 and expanded C-stud 40 each provide a savings of up to about 25% in steel compared to a standard I-stud or C-stud of similar gauge steel and similar basic dimensions. The expanded studs can be formed from sheet steel of various thicknesses, preferably from about 25 gauge up to about 16 gauge. The angle between the outer edges 22 and the side edges 26 is preferably about 60°, and the corners 27 of the tabs are preferably slightly rounded. A typical expanded I-stud 30 or expanded C-stud 40 according to the specific example set out herein has an expanded width of between about 2½ and 4½ inches. A standard prior art 3⅝ inch C-stud requires a 6.4 inch wide strip of steel. The expanded web C-stud 50, according to this invention, requires a 5.275-inch wide strip, a savings of 18%.

The resulting expanded web of I-stud 30 or C-stud 40 contains truss-like diagonals, providing a very efficient design in maintaining structural performance. The sound transmission and heat transmission of I-stud 30 and C-stud 40 are substantially lower than standard I-studs and C-studs.

The invention is equally applicable to floor and ceiling tracks, ceiling grid systems and other roll-formed, elongated, metal structural elements.

Having completed a detailed disclosure of the preferred embodiments of my invention so that those skilled in the art may practice the same, I contemplate that variations may be made without departing from the essence of the invention or the scope of the appended claims.

What is claimed is:

1. A method of making an expanded metal structural member, comprising the steps of:

severing an elongated strip of sheet metal along a sinuous shear line, thereby forming two substantially identical halves of said strip, with each half including a side portion connected to a continuously repeating pattern of keystone-shaped tabs along said shear line, with each of said tabs having a relatively wide outer edge and a relatively narrow inner end, separating said halves by moving said halves opposite one another until outer corners of said tabs of one of said halves overlap corresponding outer corners of said tabs of the other of said halves, and then affixing said overlapping corners together.

2. The method of claim 1, and further comprising the step of roll forming said side portions of said strip into spaced parallel flanges.

3. The method of claim 2, including performing said severing, separating, affixing and roll forming of said flanges while said strip of sheet metal continually advances.

4. The method of claim 1, including performing said severing, separating and affixing while said strip of sheet metal continually advances.

5. The method of claim 1, wherein said affixing comprises forming overlapping reverse bends in said overlapped outer corners and tightly crimping said bends.

6. The method of claim 5, including performing said severing, separating and affixing while said strip of sheet metal continually advances.

7. The method of claim 1, wherein said affixing comprises mechanically connecting said overlapped outer corners.

8. The method of claim 1, wherein said affixing comprises welding said overlapped corners together.

9. The method of claim 8, including performing said severing, separating and affixing while said strip of sheet metal continually advances.

10. The method of claim 1, wherein said tabs are about 1¾ inches deep and said separating step includes moving said two halves opposite one another by about 1⅜ inches.

* * * * *

UNITED STATES PATENT AND TRADEMARK OFFICE

CERTIFICATE OF CORRECTION

PATENT NO. : 5,661,881

DATED : September 2, 1997

INVENTOR(S) : Menchetti

It is certified that error appears in the above-identified patent and that said Letters Patent is hereby corrected as shown below:

Column 1, line 11, insert --components-- after "framing".

Signed and Sealed this

Fifth Day of May, 1998

Bruce Lehman

*Attest:*

BRUCE LEHMAN

*Attesting Officer*

*Commissioner of Patents and Trademarks*